US011352946B2

(12) United States Patent
Dylong et al.

(10) Patent No.: US 11,352,946 B2
(45) Date of Patent: Jun. 7, 2022

(54) COOLING UNIT FOR AN INTAKE SYSTEM

(71) Applicant: Ford Global Technologies, LLC, Dearborn, MI (US)

(72) Inventors: Krystian Dylong, Cologne (DE); Rainer Kiehn, Frechen (DE); Georg Louven, Neuwied (DE); Christoph Niederhut, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/110,182

(22) Filed: Dec. 2, 2020

(65) Prior Publication Data

US 2021/0164386 A1 Jun. 3, 2021

(30) Foreign Application Priority Data

Dec. 2, 2019 (DE) ..... 102019008356.3

(51) Int. Cl.

| | |
|---|---|
| ***F02B 39/00*** | (2006.01) |
| ***F02B 29/04*** | (2006.01) |
| ***F02M 35/024*** | (2006.01) |
| ***F02B 39/10*** | (2006.01) |
| *F02B 39/16* | (2006.01) |

(52) U.S. Cl.

CPC ..... *F02B 39/005* (2013.01); *F02B 29/0437* (2013.01); *F02B 39/10* (2013.01); *F02M 35/02483* (2013.01); *F02B 2039/164* (2013.01)

(58) Field of Classification Search

CPC .... F02B 39/005; F02B 29/0437; F02B 39/10; F02B 2039/164; F02B 29/0475; F02B 33/40; F02B 29/34; F02M 35/02483; F02M 35/042; F02M 35/10157; F02M 2700/4359

USPC ..... 123/563

See application file for complete search history.

(56) References Cited

U.S. PATENT DOCUMENTS

| | | | | |
|---|---|---|---|---|
| 3,077,731 | A * | 2/1963 | Addie | F02B 33/00 60/599 |
| 4,202,296 | A * | 5/1980 | Nonnenmann | F01P 11/10 123/41.48 |
| 6,619,275 | B2 | 9/2003 | Wiik | |
| 6,779,591 | B2 * | 8/2004 | Ehlers | F01P 3/18 123/41.49 |
| 6,832,643 | B1 * | 12/2004 | Zobel | F28D 1/0426 165/41 |
| 7,299,861 | B2 * | 11/2007 | Lo | H01L 23/473 165/125 |
| 8,099,956 | B2 | 1/2012 | Wegner | |
| 9,145,858 | B2 | 9/2015 | Maceroni et al. | |
| 2004/0020477 | A1 * | 2/2004 | Vaught | F01P 9/06 123/563 |

FOREIGN PATENT DOCUMENTS

| | | | | |
|---|---|---|---|---|
| DE | 10215779 | A1 | 11/2003 | |
| GB | 1509488 | A * | 5/1978 | F01P 5/02 |
| WO | 2018037171 | A1 | 3/2018 | |
| WO | 2018060615 | A1 | 4/2018 | |

* cited by examiner

*Primary Examiner* — J. Todd Newton

(74) *Attorney, Agent, or Firm* — Geoffrey Brumbaugh; McCoy Russell LLP

(57) ABSTRACT

Systems are provided for a combined compressor-cooling unit for an intake system. In one example, the system includes a housing, with a compressor, a liquid cooling system, a filter, and an air intake arranged within the housing such that the filter encases the compressor at least in part.

16 Claims, 2 Drawing Sheets

COOLING UNIT FOR AN INTAKE SYSTEM

CROSS-REFERENCE TO RELATED APPLICATIONS

The present application claims priority to German Patent Application No. 102019008356.3 filed on Dec. 2, 2019. The entire contents of the above-listed application is hereby incorporated by reference for all purposes.

FIELD

The present description relates generally to a combined compressor/cooling unit having a compressor for delivering air, a liquid cooling system for cooling the air and a filter for cleaning the air.

BACKGROUND/SUMMARY

Compressors and cooling arrangements may be used, for example, with internal combustion engines that act as a drive for motor vehicles. In the context of the present disclosure, the term "internal combustion engine" includes spark-ignition engines and diesel engines but also hybrid internal combustion engines that use a hybrid combustion process, as well as hybrid drives, which, in addition to an internal combustion engine, comprise an electric machine that can be connected in terms of drive to the internal combustion engine and absorbs power from the internal combustion engine or outputs additional power as a selectable auxiliary drive.

Internal combustion engines may be equipped with pressure charging, pressure charging primarily being a method of boosting power in which the charge air desired for the combustion process in the engine is compressed, thereby enabling a larger charge air mass to be supplied to each cylinder in each operating cycle. It is thereby possible to increase the fuel mass and hence the mean pressure.

Pressure charging may boost the power of an internal combustion engine while leaving the displacement unchanged or of reducing the displacement for the same power. In either case, pressure charging may lead to an increase in the power to volume ratio and a more favorable power to mass ratio. If the displacement is reduced, then it is possible, for the same vehicle boundary conditions, for the load population to be shifted toward higher loads, at which specific fuel consumption is lower. Consequently, pressure charging an internal combustion may minimize fuel consumption. to improve the efficiency of the internal combustion engine.

Through suitable design of the transmission, it is additionally possible to implement "downspeeding", whereby lower specific fuel consumption is likewise achieved. In downspeeding, a specific fuel consumption may be lower at low engine speeds and at higher loads.

An exhaust turbocharger, in which a compressor and a turbine are arranged on the same shaft, may be used for pressure charging. The hot exhaust gas flow may be fed to the turbine where it may expand, while releasing energy in the turbine, thereby imparting rotation to the shaft. The energy released to the shaft by the exhaust gas flow may be used to drive the compressor, which is likewise arranged on the shaft. The compressor delivers and compresses the charge air fed to it, as a result of which pressure charging of the at least one cylinder may be achieved. It may be desired if a charge air cooler is provided downstream of the compressor in the intake system, said coolant being used to cool the compressed charge air before it enters the at least one cylinder. The cooler lowers the temperature and thus increases the density of the charge air, thus ensuring that the cooler also contributes to better filling of the cylinders due to a larger air mass. There is as it were compression due to cooling.

The compressor of an exhaust turbocharger, together with the charge air cooler arranged downstream of the compressor, is one example of a compressor/cooling unit of the type stated at the outset, wherein the air is normally filtered before entry to the compressor in order to remove impurities in the air.

A benefit of an exhaust turbocharger in comparison with a supercharger that can be driven via an auxiliary drive is that an exhaust turbocharger uses the exhaust gas energy of the hot exhaust gases, whereas a supercharger draws the energy used to drive it directly or indirectly from the internal combustion engine and thus may have a reduced efficiency, unless the driving energy stems from energy recovery.

If it is not a supercharger which can be driven via an electric machine, e.g. an electrically drivable supercharger, there is a desire for a mechanical or kinematic connection for power transmission between the supercharger and the internal combustion engine.

The benefit of a supercharger over an exhaust turbocharger may include where the supercharger can generate and provide boost pressure irrespective of the operating state of the internal combustion engine, in particular irrespective of the instantaneous speed of the crankshaft. This applies to a supercharger which can be driven electrically via an electric machine.

According to the previous examples, there may be issues in increasing the power via exhaust turbocharging in all engine speed ranges. A relatively sharp drop in torque may be observed when the engine speed falls below a certain level. This drop in torque may be due to the boost pressure ratio depending on the turbine pressure ratio. If the engine speed is reduced, this leads to a lower exhaust gas mass flow and thus to a lower turbine pressure ratio. Consequently, the boost pressure ratio likewise decreases towards lower engine speeds. This is equivalent to a drop in torque.

However, a compressor/cooling unit may not be used to only cool the charge air of an internal combustion engine.

The internal combustion engine as such is a component subject to high thermal stresses. In principle, there is the possibility of embodying the engine cooling system in the form of an air cooling system or of a liquid cooling system. In the case of air cooling, the internal combustion engine may be equipped with a blower (e.g., a compressor), wherein heat dissipation is accomplished via an air flow passed over the surface of the internal combustion engine.

Owing to the higher heat capacity of liquids relative to air, larger quantities of heat can be dissipated with a liquid cooling system than is possible with an air cooling system.

A liquid cooling system may demand that the internal combustion engine or cylinder head and/or the cylinder block be equipped with a coolant jacket (e.g., the arrangement of coolant ducts that carry the coolant through the cylinder head and/or the cylinder block). The heat released to the coolant is removed from the coolant again in a heat exchanger, which may be arranged in the front end region of the vehicle.

Modern motor vehicle drives may be equipped with fan motors in order to provide the air mass flow desired for sufficiently high heat transfer. However, another significant parameter, namely the surface area provided available for cooling the air, may not be embodied in an arbitrary size or enlarged to an arbitrary extent since the available space in the front end region of the vehicle, where various or several heat exchangers are normally arranged, is limited.

Apart from the heat exchanger of an engine cooling system or a charge air cooler for enhanced filling of the cylinders or the heat exchanger of a charge air cooling system, an oil cooler is provided in individual cases in order to comply with a maximum permissible oil temperature. Moreover, modern internal combustion engines may be equipped with an exhaust gas recirculation system. The exhaust gas recirculation system may counteract the formation of nitrogen oxides. In order to achieve a significant reduction in nitrogen oxide emissions, high exhaust gas recirculation rates are desired, and these demand cooling of the exhaust gas to be recirculated, (e.g., compression of the exhaust gas by cooling). Additional coolers can be provided, e.g. for cooling the transmission oil in the case of automatic transmissions and/or for cooling hydraulic fluids, such as hydraulic oil, which is employed in the context of hydraulically actuable adjusting devices or for power steering. The air-conditioning condenser of an air-conditioning system is likewise a heat exchanger, which is configured to dissipate heat to the environment during operation, and therefore demands a sufficiently high air flow and hence may be arranged in the front end region.

Owing to the restricted space conditions in the front end region and the large number of heat exchangers, it is not possible to dimension the individual heat exchangers to match the requirements.

According to the previous examples, or a compressor/cooling unit may comprise a large packaging demand since a number of components have to be arranged in series and the individual components themselves normally have a large overall volume. Both in the case of the liquid cooling system and of the filter, the aim is an area which is as large as possible, while the large-area design leads to a correspondingly large volume.

In one example, the issues described above may be addressed by a system a compressor housing comprising a compressor, a cooler, and a filter, wherein the cooler is cylindrically shaped and surrounds the compressor within the housing. In this way, a packaging size of the housing may be reduced while providing enhanced cooling.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
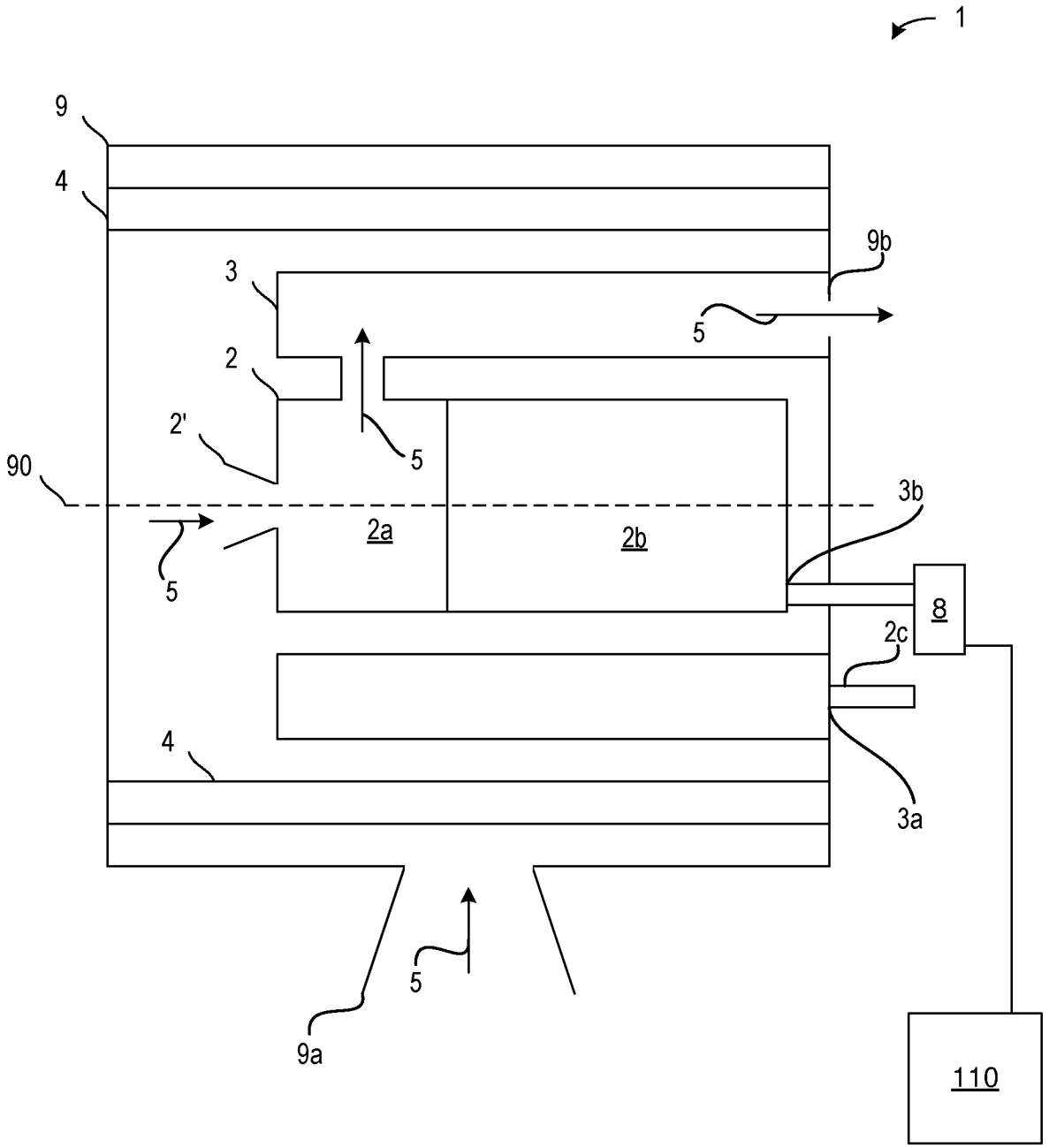
FIG. 1 shows schematically a first embodiment of the compressor/cooling unit.
Figure 2:
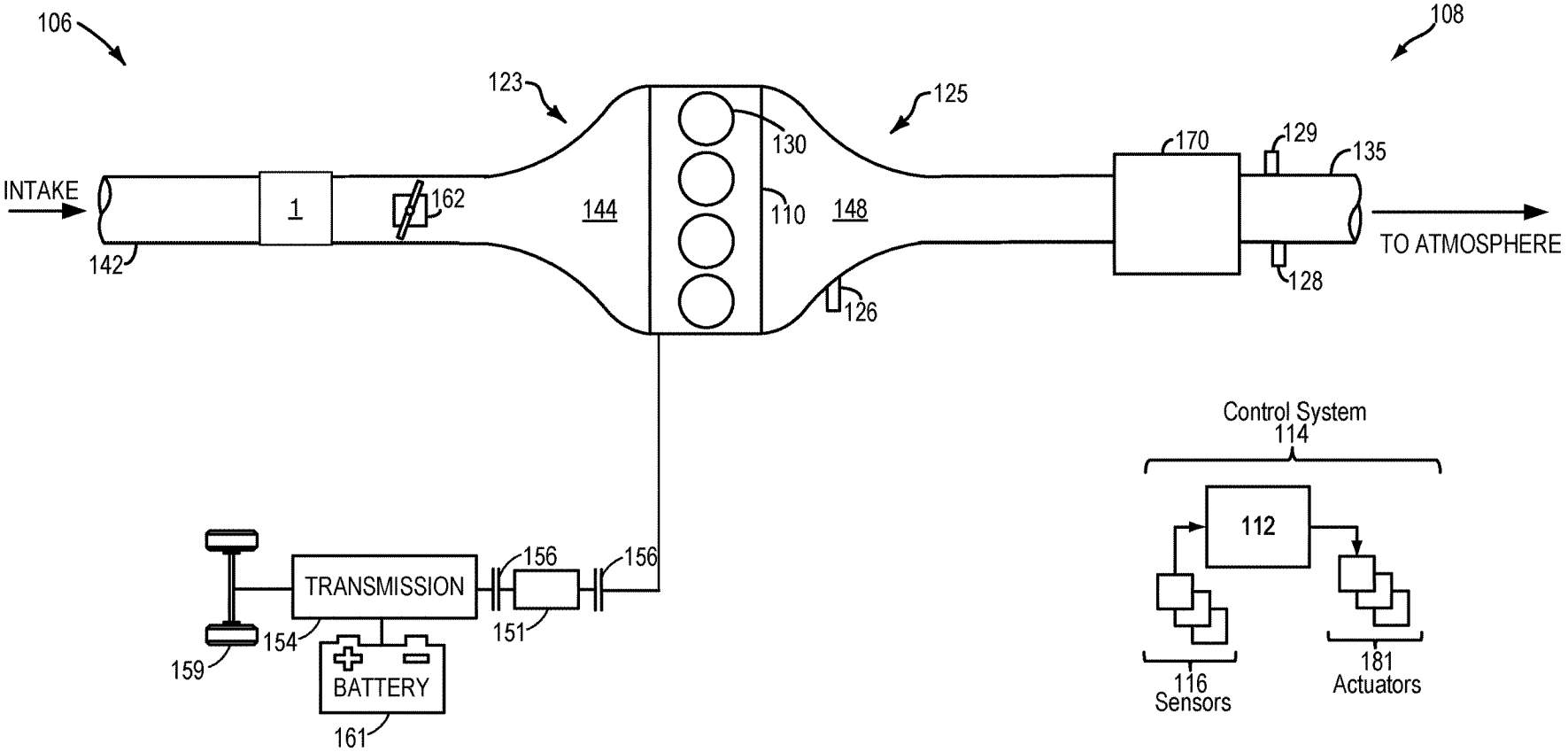
FIG. 2 illustrates a schematic of an engine included in a hybrid vehicle.

The following description relates to systems and methods for an engine intake system. FIG. 1 shows schematically a first embodiment of the compressor/cooling unit. FIG. 2 illustrates a schematic of an engine included in a hybrid vehicle.

In one example, a combined compressor/cooling unit having a compressor for delivering air, a liquid cooling system for cooling the air and a filter for cleaning the air, in which the compressor and the filter are arranged spaced apart from one another, and the liquid cooling system is arranged between the compressor and the filter, and which is characterized in that the combined compressor/cooling unit is of onion-like construction, inasmuch as the filter encases the compressor over an outer circumference, at least in some region or regions.

The compressor/cooling unit according to the disclosure is very compact in comparison with the previous examples in the art. This effect is achieved by the onion-like construction of the unit.

The compressor and the filter are arranged spaced apart from one another, wherein the liquid cooling system is positioned between the compressor and the filter. Here, however, the individual components are not arranged in series, e.g. along the intake line of an intake system of an internal combustion engine but are positioned from the inside outwards.

The compressor is located in the interior or in the innermost part of the compressor/cooling unit according to the disclosure. The compressor is encased on the outside—at least in some region or regions—by the liquid cooling system in the manner of a housing, similarly to a sheathing element, wherein the liquid cooling system, in turn, is encased—at least in some region or regions—by the filter in the manner of a housing, similarly to a sheathing element. That is to say that the liquid cooling system and the filter are arranged in a shell-like manner around the compressor as the core of the unit, e.g. similarly to the layers of an onion, namely from the inside outwards.

Embodiments in which the compressor is of cylinder-type design and the filter and the liquid cooling system are of sleeve-type design may be desired. In the context of assembly, the individual components are then pushed one inside the other in telescopic fashion.

The construction according to the disclosure of the compressor/cooling unit has further enhanced effects.

The distance which the air travels, starting from the filter, as it flows through the compressor as far as the outlet from the liquid cooling system is short than in the configurations of the previous examples.

The liquid cooling system positioned around the outside of the compressor, and also the filter, muffle the noise emanating from the compressor; in particular the noise emanating from the electric motor in the case of an electrically driven compressor.

In principle, the development work in the context of vehicle acoustics is focused on noise reduction, wherein, apart from the drive unit, e.g. the internal combustion engine, as the dominant source of noise, the secondary units also contribute to total noise emissions. This development work is motivated by the realization that noises may be bothersome to a customer. Moreover, noise emissions are also increasingly relevant and taken into account from health perspectives.

Embodiments of the combined compressor/cooling unit in which the liquid cooling system is a liquid cooling system operated with water as the coolant may be desired.

Water may comprise a relatively high heat capacity while being easily available and inexpensive. Moreover, water may be available as an operating fluid. Additives, e.g. glycol, may be added to the water. In this way, it is also possible to lower the freezing point of water.

Embodiments of the combined compressor/cooling unit in which the liquid cooling system is fluidically connected to an engine cooling system of an internal combustion engine may be utilized.

In the present case, the liquid cooling system of the compressor/cooling unit according to the disclosure is fluidically connected to the liquid cooling system of an internal combustion engine. In this way, the two circuits of the liquid cooling systems can share a container for storing the coolant and a pump for delivering the coolant. This lowers costs and reduces the packaging constraints since it is possible to utilize an available container for storing the coolant and of an already available pump for delivering the coolant.

Embodiments of the combined compressor/cooling unit in which the compressor is an electrically driven compressor may be utilized. This eliminates a mechanical or kinematic connection for power transmission for introducing a driving power.

Moreover, in contrast to a mechanically driven supercharger, an electrically driven compressor is independent of the operating state of any internal combustion engine provided in the particular case.

Embodiments of the combined compressor/cooling unit in which the electrically driven compressor comprises a rotor assembly and an electric motor may be utilized.

The rotor assembly comprises at least one rotatably mounted rotor equipped with the rotor blades. Fundamentally, the rotor assembly can be designed with a view to increasing the pressure in the air delivered or, alternatively, with a view to a maximum throughput, e.g. a maximum delivery flow. The latter is the aim in the context of the present disclosure. The compressor should deliver an air quantity which is as large as possible, like a blower.

If the compressor is an electrically driven compressor, embodiments in which the electric motor is equipped with a further liquid cooling system may be utilized. In individual cases, it may namely be desired to cool the electric motor and to dissipate the heat generated during the operation of the electric motor. This is intended to block overheating of the electric motor and to ensure the capacity to function of the electric motor.

Embodiments of the combined compressor/cooling unit in which the liquid cooling system is fluidically connected to the further liquid cooling system of the electric motor may be utilized. In this way, the further liquid cooling system can share a container for storing the coolant and a present pump for delivering the coolant. This reduces costs and the space requirements.

The present embodiment is also distinguished by the fact that the further liquid cooling system of the electric motor can be supplied with coolant by the liquid cooling system of the combined compressor/cooling unit and that, after flowing through the further liquid cooling system of the electric motor, the coolant can be introduced or discharged into the liquid cooling system of the combined compressor/cooling unit. These two concepts are implemented physically by the two following embodiments and lead to a different sequence of flow.

Embodiments of the combined compressor/cooling unit in which the liquid cooling system is equipped with an inlet for supplying the coolant, and the further liquid cooling system is equipped with an outlet for discharging the coolant may be utilized.

In the present case, the coolant flows first through the liquid cooling system and then through the further liquid cooling system.

Embodiments of the combined compressor/cooling unit in which the liquid cooling system is equipped with an outlet for discharging the coolant, and the further liquid cooling system is equipped with an inlet for supplying the coolant may be utilized.

In the present case, the coolant flows first through the further liquid cooling system and then through the liquid cooling system.

In principle, embodiments of the combined compressor/cooling unit in which the compressor is a mechanically driven compressor may be utilized. Although a mechanically driven compressor may not be as efficient as an electrically driven compressor, it has the benefit over an electrically driven compressor of being independent of the state of charge of a storage device for the electric energy; e.g. a battery.

Embodiments of the combined compressor/cooling unit in which the compressor/cooling unit is of cylindrical design, wherein the liquid cooling system and the filter extend in a manner which corresponds to a cylindrical shape, e.g. are of sleeve-type design, at least in some region or regions, may be utilized.

Embodiments of the combined compressor/cooling unit in which the compressor is arranged downstream of the filter and upstream of the liquid cooling system may be utilized. In that case, the flow after the filter is first of all through the compressor and then through the cooling system. Any increase in temperature due to compression or delivery is counteracted in this way. Embodiments in which the combined compressor/cooling unit is arranged in the front end region of a vehicle may be utilized.

Air to be supplied to an internal combustion engine of a motor vehicle is cooled using the compressor/cooling unit.

The liquid cooling system then acts as a charge air cooler, and the compressor is used for pressure charging.

Uses in which the oil of a drive unit or internal combustion engine is cooled using the compressor/cooling unit may be utilized.

Uses in which exhaust gas from an internal combustion engine which is to be recirculated is cooled using the compressor/cooling unit may be utilized.

Uses in which the transmission oil of a transmission is cooled using the compressor/cooling unit may be utilized.

Uses in which the hydraulic oil of a hydraulically actuatable adjusting device or power steering system is cooled using the compressor/cooling unit may be utilized.

Uses in which the compressor/cooling unit is used as part of an air-conditioning system may be utilized.

Turning now to FIG. 1, it shows a first embodiment of the compressor/cooling unit 1 having an electrically driven compressor 2 for delivering air, a liquid cooling system 3 for cooling the air and a filter 4 for cleaning the air.

Here, the components 2, 3, 4 are not arranged in series but are arranged in an onion-like structure from the inside outwards. The compressor 2 and the filter 4 are arranged spaced apart, and the liquid cooling system 3 is arranged between the compressor 2 and the filter 4. Said another way, the filter 4, the liquid cooling system 3, and the compressor 2 are arranged concentrically about an axis 90 of the compressor/cooling unit 1. The compressor 2 is arranged closest to the axis 90, wherein the liquid cooling system 3 is arranged between the compressor 2 and the filter 4. As such, the filter 4 may be furthest from the axis 90.

Accordingly, the compressor 2 is located furthest to the inside and is encased by the liquid cooling system 3 in the manner of a housing, similarly to a sheathing element and at least in some region or regions. The liquid cooling system 3, in turn, is encased—at least in some region or regions—by the filter 4. The liquid cooling system 3 and the filter 4 surround the compressor 2 of the unit 1, which is positioned in the core, as cylindrical sleeves, e.g. similarly to the layers of an onion, namely from the inside outwards.

As a result of the onion-like construction, the unit 1 is very compact, and the distance to be traveled by the air as it flows through the unit 1 is significantly shortened relative to other configurations. The path of the air through the unit 1 is indicated by arrows 5. Starting from the filter 4, air passes via inlet 2' into the rotor assembly 2*a* of the compressor 2 and then into the liquid cooling system 3.

The onion-like construction of the compressor/cooling unit 1 also has the effect that the externally positioned liquid cooling system 3 and the externally positioned filter 4 muffle the noise emanating from the electric motor 2*b* of the compressor 2.

In the present case, the electric motor 2*b* is equipped with a further liquid cooling system 2*c*, which is intended to control a temperature of the electric motor 2*b* and ensure the capacity of the compressor 2 to function.

The liquid cooling system 3 of the unit 1 is fluidly connected to the further liquid cooling system 2*c* of the electric motor 2*b*. The liquid cooling system 3 of the unit 1 is equipped with an inlet 3*a* for supplying coolant, and the further liquid cooling system 2*c* of the electric motor 2*b* is equipped with an outlet 3*b* for discharging the water, with the result that the water flows first through the liquid cooling system 3 and then through the further liquid cooling system 2*c*.

Thus, FIG. 1 illustrates a housing 9 configured to house each of the filter 4, the liquid cooling system 3, and the compressor 2. The compressor 2 comprises a rotor assembly 2*a* and an electric motor 2*b*. In one example, the electric motor 2*b* may be configured to receive electrical energy from a battery and drive a rotor of the rotor assembly 2*a*. In one example, the electric motor 2*b* is configured to drive only the rotor and not a drive axle of the vehicle. Additionally or alternatively, the electric motor 2*b* may be configured to drive other auxiliary devices, such as an air conditioner rotor, a coolant pump, a fan, and/or components of an accessory drive device. The air flows through a housing inlet 9*a* of the housing in a first direction normal to the axis 90. The air then enters the compressor 2 via the inlet 2' in a second direction, normal to the first direction and parallel to the axis 90. The air may flow through the rotor assembly 2*a*, where the air is compressed, and then flows in the first direction to the liquid cooling system 3. The liquid cooling system 3 may further compress the compressed air via cooling before the air leaves the housing 9 via a housing outlet 9*b*, where the air may flow toward an engine. As illustrated, the air from the rotor assembly 2*a* flows directly to the liquid cooling arrangement 3 via an interconnecting passage within the housing 9. As such, there are no other inlets or additional outlets other than the compressor inlet 2' and the housing outlet 9*b*.

In the example of FIG. 1, the liquid cooling system 3 (e.g., an intercooler) comprises a cylindrical shape that circumferentially surrounds the compressor 2, including the rotor assembly 2*a* and the electric motor 2*b*. As further illustrated in the embodiment of FIG. 1, the cooler 3 comprises the coolant inlet 3*a*, where coolant from the coolant system 2*c* may enter the liquid cooling system 3 from a portion of an engine coolant system of an engine 110. In one example, the coolant system 2*c* is fluidly coupled to a radiator 8 of the vehicle. The coolant in the liquid cooling system 3 may exit the compressor/cooling unit 1 via the outlet 3*b* arranged in a housing of the electric motor 2*b* and flow to the radiator. In this way, a coolant passage or multiple coolant passages may extend from the liquid cooling system 3 to the electric motor 2*b*, thereby enhancing cooling thereof. Coolant exiting through the outlet 3*b* is returned to the cooling system 2*c*.

FIG. 2 shows a schematic depiction of a hybrid vehicle system 106 that can derive propulsion power from engine system 108 and/or an on-board energy storage device. An energy conversion device, such as a generator, may be operated to absorb energy from vehicle motion and/or engine operation, and then convert the absorbed energy to an energy form suitable for storage by the energy storage device.

Engine system 108 may include an engine 110 having a plurality of cylinders 130. As such, the cylinder 3 may be one cylinder of the plurality of cylinders 130. Engine 110 includes an engine intake 123 and an engine exhaust 125. Engine intake 123 includes an air intake throttle 162 fluidly coupled to the engine intake manifold 144 via an intake passage 142. Air may enter intake passage 142 and flow to the compressor/cooling unit 1. Engine exhaust 125 includes an exhaust manifold 148 leading to an exhaust passage 135 that routes exhaust gas to the atmosphere. Engine exhaust 125 may include one or more emission control devices 170 mounted in a close-coupled position or in a far underbody position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein.

Vehicle system 106 may further include control system 114. Control system 114 is shown receiving information from a plurality of sensors 116 (various examples of which are described herein) and sending control signals to a plurality of actuators 181 (various examples of which are described herein). As one example, sensors 116 may include exhaust gas sensor 126 located upstream of the emission control device, temperature sensor 128, and pressure sensor 129. Other sensors such as additional pressure, temperature, air/fuel ratio, and composition sensors may be coupled to various locations in the vehicle system 106. As another example, the actuators may include the throttle 162.

Controller 112 may be configured as a conventional microcomputer including a microprocessor unit, input/output ports, read-only memory, random access memory, keep alive memory, a controller area network (CAN) bus, etc. Controller 112 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines.

In some examples, hybrid vehicle 106 comprises multiple sources of torque available to one or more vehicle wheels 159. In other examples, vehicle 106 is a conventional vehicle with only an engine, or an electric vehicle with only electric machine(s). In the example shown, vehicle 106 includes engine 110 and an electric machine 151. Electric machine 151 may be a motor or a motor/generator. A crankshaft of engine 110 and electric machine 151 may be connected via a transmission 154 to vehicle wheels 159 when one or more clutches 156 are engaged. In the depicted example, a first clutch 156 is provided between a crankshaft and the electric machine 151, and a second clutch 156 is provided between electric machine 151 and transmission 154. Controller 112 may send a signal to an actuator of each clutch 156 to engage or disengage the clutch, so as to connect or disconnect crankshaft from electric machine 151 and the components connected thereto, and/or connect or disconnect electric machine 151 from transmission 154 and the components connected thereto. Transmission 154 may be a gearbox, a planetary gear system, or another type of transmission. The powertrain may be configured in various manners including as a parallel, a series, or a series-parallel hybrid vehicle.

Electric machine 151 receives electrical power from a traction battery 161 to provide torque to vehicle wheels 159. Electric machine 151 may also be operated as a generator to provide electrical power to charge battery 161, for example during a braking operation.

The controller 112 may be configured to signal to an actuator of the compressor/cooling unit 1 to rotate a rotor of a rotor assembly by drawing power from the battery 161. The electric motor of the compressor/cooling unit 1 may be a separate electric motor from the electric motor 151.

FIGS. 1-2 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

In this way, a compressor housing comprises a cooler and an air filter box integrally arranged therein. The cooler is cylindrically arranged on the compressor. Air flow through the filter, to the compressor, to the cooler, and then to an engine. The technical effect of integrally arranging the cooler and filter in the compressor housing is to decrease a packaging size of the compressor. By designing the cooler with a cylindrical shape, the cooler may be packaged closer to the compressor, which may be decrease a packaging of the compressor housing and cooling unit.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily desired to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

a compressor housing, a compressor, a cooler, and a filter, wherein the cooler is cylindrically shaped and surrounds the compressor within the compressor housing;

wherein the compressor is electrically driven via an electric motor; and wherein the cooler directs coolant to the electric motor, and wherein coolant from the electric motor is discharged through an outlet configured to expel the coolant from the compressor housing.

2. The system of claim 1, wherein the cooler is arranged between the compressor and the filter.

3. The system of claim 1, wherein the cooler is a liquid cooling system.

4. The system of claim 1, wherein the cooler is fluidly coupled to an engine cooling system.

5. The system of claim 1, wherein the electric motor is arranged in the compressor housing.

6. The system of claim 1, wherein the cooler surrounds the electric motor.

7. An intake system, comprising:

a housing, a compressor, an electric motor, a cooler, and an air filter integrally arranged therein, wherein the cooler is fluidly coupled to a radiator of an engine coolant system and wherein the air filter, the compressor, and the cooler are concentric about an axis of the housing.

8. The intake system of claim 7, wherein the cooler comprises a cylindrical shape and circumferentially surrounds the compressor and the electric motor.

9. The intake system of claim 8, wherein the air filter is arranged radially outside of the cooler, and wherein there is a gap between the air filter and the cooler.

10. The intake system of claim 8, wherein a rotor assembly is arranged within the housing and surrounded by the cooler, wherein the rotor assembly is in face-sharing contact with the electric motor and fluidly coupled to the cooler.

11. The intake system of claim 7, wherein the compressor expels compressed air directly to the cooler within an interior volume of the housing.

12. The intake system of claim 7, wherein the cooler receives coolant from the engine coolant system, and wherein the electric motor expels coolant from the housing to the radiator.

13. A system, comprising:

a housing containing a compressor surrounded by a cylindrically shaped cooler, the housing further containing an air filter integrally arranged therein;

wherein the housing comprises a single inlet, wherein the inlet is configured to direct air to the air filter, wherein air flows to the compressor after flowing through the air filter, and wherein air from the compressor flows through the cylindrically shaped cooler, and through an outlet of the housing toward an engine intake.

14. The system of claim 13, wherein there are no additional inlets or other outlets other than the single inlet and the outlet of the housing.

15. The system of claim 13, wherein the cylindrically shaped cooler is fluidly coupled to an electric motor of the compressor.

16. The system of claim 13, wherein the compressor, the cylindrically shaped cooler, and the air filter are concentric about an axis of the housing.

* * * * *